United States Patent [19]

Grobe

[11] 3,959,758

[45] May 25, 1976

[54] MAGNETICALLY ACTUATED SWITCHING DEVICE

[75] Inventor: Wolfgang Grobe, Ludwigsburg, Germany

[73] Assignee: International Standard Electric Corporation, New York, N.Y.

[22] Filed: Nov. 27, 1974

[21] Appl. No.: 527,724

[30] Foreign Application Priority Data

Dec. 7, 1973 Germany ..... 2361185

[52] U.S. Cl. ..... 335/153; 335/151

[51] Int. Cl.[2] ..... H01H 51/27

[58] Field of Search ..... 335/153, 154, 152, 151

[56] References Cited

UNITED STATES PATENTS

| | | | |
|---|---|---|---|
| 3,510,812 | 5/1970 | Takamura et al. | 335/153 |
| 3,624,568 | 11/1971 | Olsen et al. | 335/153 |
| 3,805,378 | 4/1974 | Archer et al. | 335/153 |

*Primary Examiner*—Harold Broome

*Attorney, Agent, or Firm*—John T. O'Halloran; Menotti J. Lombardi, Jr; Richard A. Menelly

[57] ABSTRACT

A magnetically actuated switching device using reversibly magnetizable armatures treated by a selective annealing process. The annealing process changes the homogeneous coercive magnetic properties of the armatures so that the highest coercive force is caused to occur in the region of the armature which is subjected to magnetizing forces from an energizing coil, and the region of the armature existing outside the magnetizing field is annealed in a manner to lower the coercive force of the armature. Selectively annealing the armature to provide high coercive force in the vicinity of the magnetizing coil reduces the amount of magnetizing force necessary to be supplied by the coil for switching the armature from a closed to an open contact position.

2 Claims, 5 Drawing Figures

9
10
6
4
3
5
7
8
2
1

Hc

Hc

Hc
11
12

MAGNETICALLY ACTUATED SWITCHING DEVICE

FIELD OF THE INVENTION

The present invention relates to a switching device capable of being magnetically actuated, wherein the magnetic flux-determining structure consists either completely or partly of a reversible hardmagnetic material.

BACKGROUND OF THE INVENTION

The above mentioned switching devices are known, for example, in the form of relays employing self-holding reed contacts having reed contact armatures made from a reversible hard-magnetic material. In cases where the reed contact armatures consist completely, that is throughout their entire length, of a reversible hard-magnetic material, the magnetic length of the reed contact armature is much greater than the length of the associated magnetizing coil. This variation between the magnetic lengths of the reed contact armatures and the lengths of the magnetizing coils can only be compensated for by increasing the driving power of the magnetizing coils. In order to eliminate this deficiency, it is known to adapt the magnetic lengths of the reed contact armatures sectionally to the lengths of the magnetizing coils. In so doing, the total length of each reed contact armature is manufactured from at least two parts, i.e. the resilient and reversible hard-magnetic parts of the reed contact armature arranged overlappingly opposite each other within the protective envelope (reed tubing), are each connected via a short flat spring, to a shaft made from a material capable of being sealed in glass. This way, of course, achieves a good adaptation of the magnetic lengths of the reed contact armatures to the lengths of the magnetizing coils, as well as good sealing properties to the reed contact armatures, but this method causes unnecessary joints and magnetically separating gaps, so that the use of a magnetically separating spring is not considered favorable. The construction is complicated and expensive also because four welding points are inside the protective envelope and are subject to the disadvantage of embrittlement within the welding area.

SUMMARY OF THE INVENTION

It is an object of this invention to provide a switching device capable of being magnetically actuated, in which the driving power required for pulsing is reduced without having to subdivide the part made of reversible hard-magnetic material. According to the broader aspects of this invention this is accomplished by causing the coercive force of this material to be considerably irregular along one main path of the magnetic flux. The mechanical and material composition properties of the reed contact armature otherwise remain essentially homogeneous throughout the armature extent.

This controlled distribution of the coercive force, along the axis of the reed contact armatures of a self-holding reed contact can be achieved with the aid of an inhomogeneous annealing (within the field of a temperature gradient). In the process of adjusting the coercive force the subsequent changes in coercitivity during sealing, welding or soldering are taken into effect. In this way the distribution of the coercive force along the axis of the reed contact armature can be optimally adapted to the position of the magnetizing coils and to the variation of the material at the sealing points due to heating.

The improved switching device of this invention, therefore, enables the design of smaller crosspoints having more favorable minimum operating (pick-up) values.

The invention will now be explained in greater detail with reference to an operable embodiment as shown in FIGS. 1 to 5 of the accompanying drawings.

DESCRIPTION OF THE PREFERRED EMBODIMENT

Figures 1, 2, 3, 4:
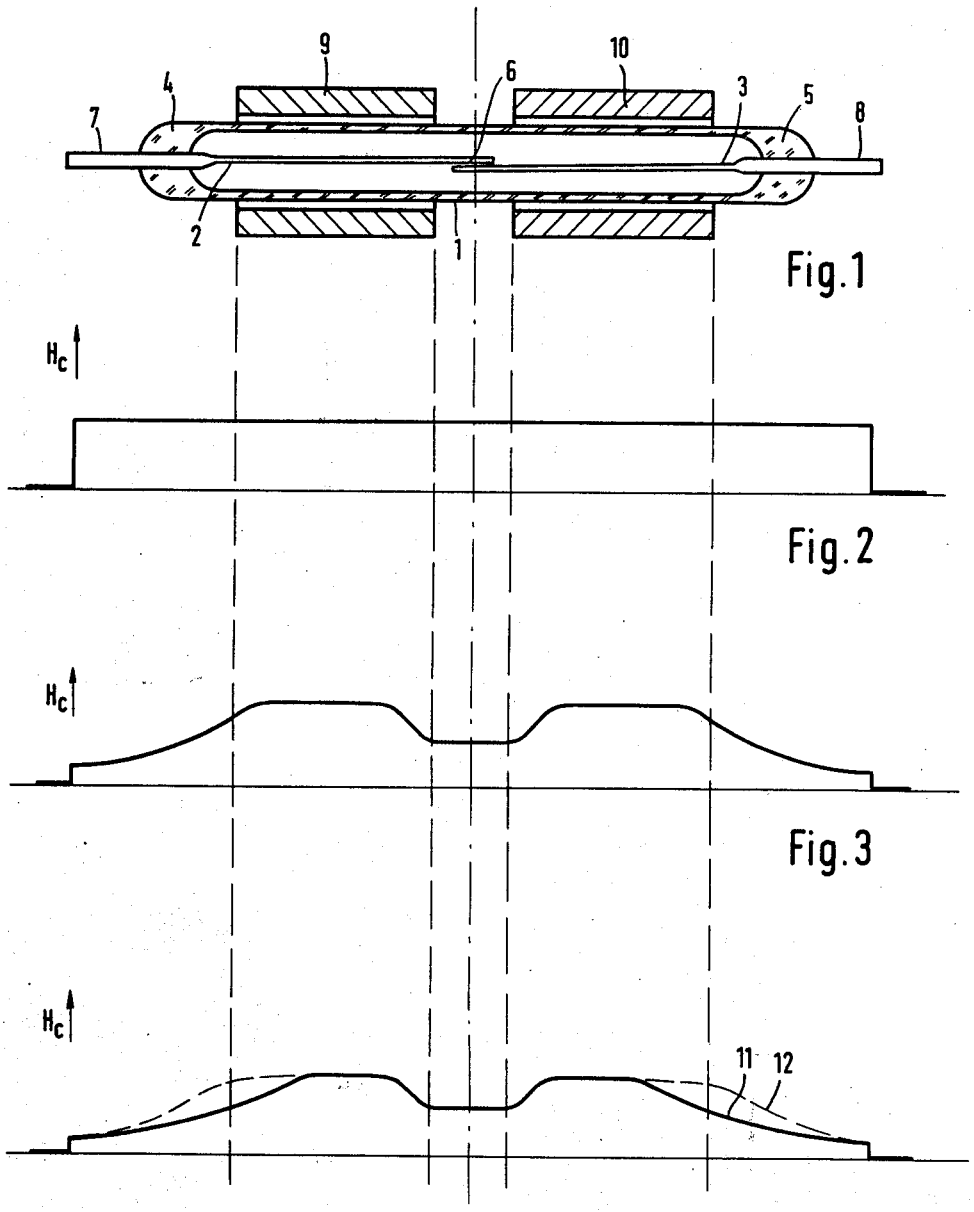
FIG. 1 is a sectional view of a reed contact employing hardmagnetic reed contact armatures.
FIGS. 2,3 and 4 are graphic illustrations of the relationship between the amount of coercive force as a function of distance along the axis of the reed contact armatures.

FIG. 1 shows a locking relay (latching relay) with a self-holding reed contact and a protective glass envelope 1 in which two reed contact armatures 2 and 3 of a reversible hard-magnetic material are hermetically sealed. The glass-to-metal seals are indicated by the reference numerals 4 and 5. The reed contact armatures 2 and 3 oppose one another inside the protective envelope 1 (reed tubing) with their overlapping contact ends 6, while their terminals 7 and 8 project out of the protective envelope 1. Each reed contact armature 2 and 3 is accociated with one magnetizing coil 9 or 10 arranged next to each other on the protective envelope 1. In the case of this self-holding reed contact the coercive force along the axis of the reed contact armatures 2, 3 within the area of the magnetizing coils 9, 10 is greater than in the range of the terminals 7, 8, the sealing points 4, 5, and the contact ends 6.

The diagram of FIG. 2 shows the curve relating to the coercive force $H_c$ as plotted over the reed contact armatures 2, 3, in cases where the reed contact armatures 2, 3 have been subjected in the known manner of homogeneous annealing. It can be clearly seen that the magnetically effective length of the reed contact armatures 2, 3 in no way corresponds to the lengths of the magnetizing coils 9, 10. For the pulsewise polarity reversal of the hard-magnetic reed contact armatures 2 and 3, therefore, the magnetizing coils 9 and 10 are required to have a relatively high driving power.

FIG. 3 is a diagram showing the amount of coercive force $H_c$ plotted along the axis of the reed contact armatures 2, 3 in cases where the armatures have previously been subjected to an inhomogeneous annealing in accordance with the instant invention. The coercive force $H_c$, therefore, is considerably irregular along the axis of the reed contact armatures 2, 3 and adapted to the position and size of the magnetizing coils 9, 10. The maximum of the coercive force $H_c$ is now in agreement with the position of the maximum field intensity of the magnetizing coils 9 and 10. In this embodiment of the reed contact armatures 2, 3 the driving power of the magnetizing coils 9, 10 can therefore be considerably reduced.

FIG. 4 is a diagram showing the coercive force $H_c$ as plotted over the reed contact armatures 2, 3 in cases where the coercive force variation as effected by the sealing of the reed contact armatures 2, 3 into the protective envelope 1 has already been taken into consideration during the previous inhomogeneous annealing of the reed contact armatures 2, 3. The inhomogeneous annealing therefore results in the coercive force characteristic shown in the diagram by the solid curve 11. During the sealing of the reed contact armatures 2, 3 the coercive force at the glass-to-metal seals 4 and 5 increases, so that the finished reed contact will have a coercive force characteristic resembling the curve 12 indicated by the broken line. By this inhomogeneous annealing taking into consideration the sealing temperatures, it is not only possible to adapt the distribution of the coercive force along the axis of the reed contact armatures 2, 3 to the position of the magnetizing coils 9, 10, but also, in an optimum way, to the shape of the iron circuit parts, including the magnetic yoke or screen plate. Preferably, the cross section of the reversible hard-magnetic reed contact armatures 2, 3 is adapted to the leakage flux distribution as well as to the course of residual magnetism in the material.

Figure 5:
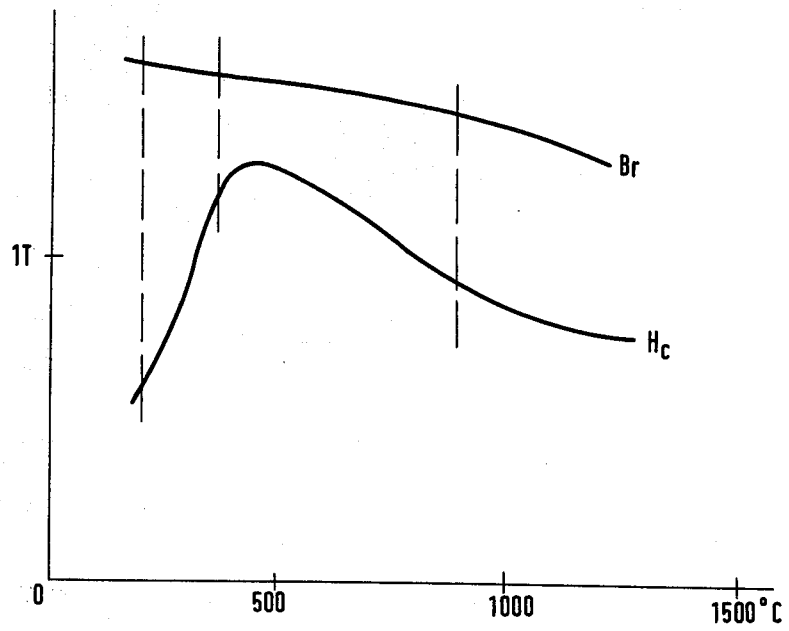
FIG. 5 is a graphic illustration of the relationship of coercive force and residual induction as a function of annealing temperature for a material suitable for use with the present invention.

The material for the reed contact armatures 2, 3 must consist of a reversible hard-magnetic alloy so that the coercive force $H_c$ can be adjusted without substantially affecting its residual induction $B_r$, by the annealing process. FIG. 5 shows an example of such a material in the form of a diagram. The annealing temperature in degree Celsius is plotted on the abscissa, and the ordinate represents the measurement relating to both residual induction $B_r$ and coercive force $H_c$, the variations due to temperature, are represented by the two curves. The diagram shows that with this material the coercive force $H_c$ can be considerably varied by means of the annealing process, whereas residual induction $B_r$ is only slightly affected.

What is claimed is:

1. A magnetically actuated switching device comprising:

a pair of reversible hard magnetic material contact armature elements enclosed in an elongated glass envelope, the terminal leads of said elements protruding externally from the elongated ends of said envelope and sealed therein;

a pair of electromagnet coils, each coil of the pair surrounding said envelope and positioned adjacent one of said elements to produce a maximum magnetic flux through said adjacent contact armature elements;

said elements being selectively annealed to restrict the coercive force within said contact armature elements to be a maximum within the section adjacent the associated electromagnetic coil; and said element having a lesser coercive force exterior the area of the coils.

2. A magnetically actuated switching device according to claim 1, wherein said elements are made of a reversible hard magnetic alloy whose coercive force $H_c$ is adjustable by annealing without substantially affecting its residual induction $B_r$ in the annealing process.

* * * * *